United States Patent [19]

Larsson

[11] Patent Number: 4,850,503

[45] Date of Patent: Jul. 25, 1989

[54] CLOSURE DEVICE FOR A PACKAGING CONTAINER

[75] Inventor: Lennart Larsson, Malmö , Sweden

[73] Assignee: AB Akerlund & Rausing, Sweden

[21] Appl. No.: 187,740

[22] Filed: Apr. 29, 1988

[30] Foreign Application Priority Data

May 6, 1987 [SE] Sweden ..... 8701855

[51] Int. Cl.[4] ..... B65D 41/32

[52] U.S. Cl. ..... 220/265; 220/266; 220/270; 220/276; 220/256

[58] Field of Search ..... 220/270, 271, 266, 265, 220/276, 257, 258

[56] References Cited

U.S. PATENT DOCUMENTS

| | | | |
|---|---|---|---|
| 4,210,618 | 7/1980 | Piltz | 220/257 |
| 4,212,409 | 6/1980 | Jeppsson | 220/276 |
| 4,267,937 | 5/1981 | Piltz | 220/270 |
| 4,408,697 | 10/1983 | Yoshikawa | 220/270 |
| 4,556,152 | 12/1985 | Bogren | 220/276 |

FOREIGN PATENT DOCUMENTS 1961877 7/1970 Fed. Rep. of Germany .

*Primary Examiner*—Stephen Marcus
*Assistant Examiner*—Gilbert W. Reece
*Attorney, Agent, or Firm*—Lerner, David, Littenberg, Krumholz & Mentlik

[57] ABSTRACT

An easy openable closure device for a packaging container, comprising an outer layer, for instance injection moulded of plastics, and an inner layer possibly comprising several sublayers and such that it gives the closure device a specific characteristics as to welding possibilities, gas barrier and light barrier. A first tearing denotation is arranged in the outer layer and merges into a second tearing denotation under a tangentially acute angle, said second denotation extending circumferentially around the closure device. At both sides of the circumferential tearing denotation, the inner layer is sealed to or connected to the outer layer. In the outer layer there is arranged an element having a portion for penetrating the first tearing denotation in the outer layer inside the said sealing region. The strength of the second tearing denotation is lower than the sealing strength between the layers and the latter strength is higher than the tearing strength of the inner layer.

17 Claims, 1 Drawing Sheet

CLOSURE DEVICE FOR A PACKAGING CONTAINER

FIELD OF THE INVENTION

The present invention relates to a closure device for a packaging container or more precisely a closure device comprising at least two layers and of the type falling under the so called easy opening concept. Especially, the invention relates to a closure device in the shape of a cover comprising an outer protective plastics layer or corresponding and a further layer inside said protective layer. Of course, said further layer may comprise several sublayers, the object of which are to give the cover specific characteristics, for instance welding possibilities, gas barrier and/or light barrier.

BACKGROUND OF THE INVENTION AND THE STATE OF THE ART

The state of the art comprises a number of easily openable covers or closures, including covers where the outer layer is a protective, relatively thick plastic layer and the inner layer a metal layer or a corresponding gas and vapour tight layer, for instance an aluminum foil or a layer of high barrier plastics. Said known structures also comprise a multitude of grip devices and different sorts of tearing denotations.

In the case where the outer layer consists of plastic, however, easily openable structures generally have the drawback that the manufacturing procedure is a two step procedure, for instance a two step injection moulding operation. This necessitates some sort of later mounting or a complex mould arrangement.

The opening procedure of known covers may include a simultaneous penetration of the outer and inner layers, but the manufacturing procedure and the known structural measures often involve a very difficult balancing act, which unfortunately may result in an end product, which does not meet the high demands for reliable opening. In other cases the opening of the closure is a two step procedure, where the protective outer layer is opened first and the inner layer, generally called the membrane, thereafter is punctured.

According to the invention it has been realized that for obtaining the desirable objects, the following requisites are necessary:

the opening arrangement shall define a well defined tearing direction, the outer and inner layers shall be opened together but sequentially such that the outer layer is first broken through, after which the inner layer is penetrated, and additionally the outer layer, or the mechanically reinforcing layer, shall be manufactured in one single step, for instance by injection moulding.

OBJECTS OF THE INVENTION

One object of the invention is to give a multilayer cover, or a cover of the "composite cover"-type, having reliable easy opening characteristics without unduly excluding a rational one step injection moulding technique for manufacturing the cover. Another object is to provide a closure structure allowing a variety of material combinations for the composite closure without deteriorating the easy opening possibilities. Additionally, a still further object is to provide a structure offering alternatives for the placement of gripping devices and tearing denotations.

The invention provides a packaging container closure device, comprising:

- a panel having an outer layer and an inner layer and arranged for a one step tearing up operation:
- a first tearing denotation in the outer layer,
- a second tearing denotation outside said first denotation in the outer layer and extending circumferentially around the entire panel,
- an adhesive region between said layers and with a limited extension at both sides of the circumferential denotation, and
- an element arranged in the outer layer and formed with a portion for initiating penetration of the first tearing denotation in the outer layer inside the adhesive region at a distance from the second tearing denotation,
- said first tearing denotation merging into the second denotation, and the strength of the second tearing denotation being lower than the adhesive strength between the layers, the latter strength being higher than the strength of the inner layer.

In one embodiment the circumferential tearing denotation is placed close to a rim of the closure device in order to give a full opening cover. Preferably, the transition between the first tearing denotation and the second tearing denotation is such that the denotations merge under a tangentially acute angle in the tearing direction.

DESCRIPTION OF A PREFERRED EMBODIMENT

Figure 1:
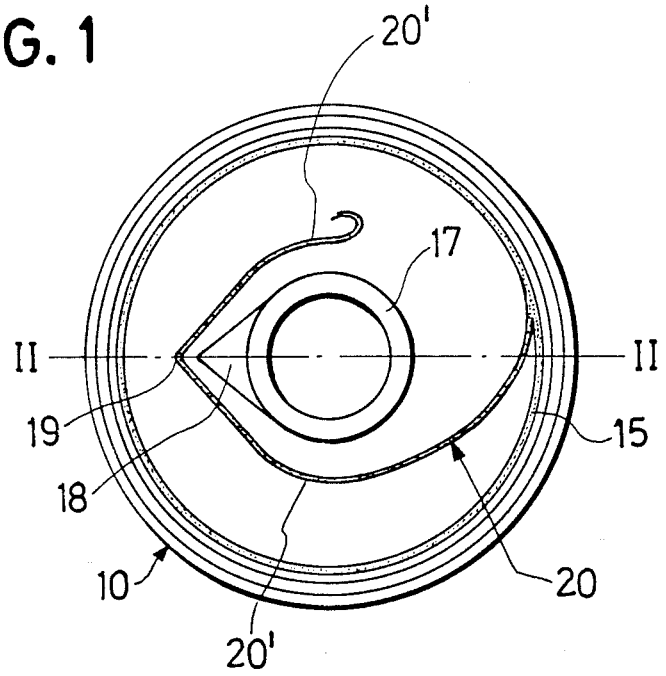
FIG. 1 is a plan view showing one embodiment of a closure device according to the invention.
Figure 2:
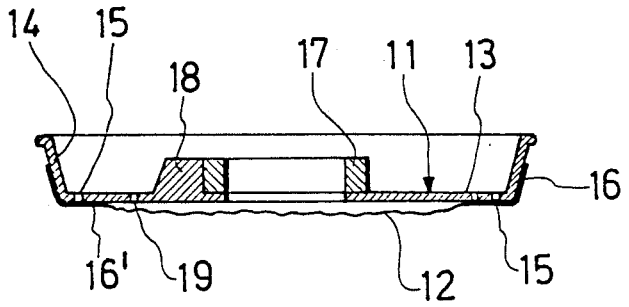
FIG. 2 is a sectional view of the device of the present invention as taken along line II—II of FIG. 1.

The closure device 10 in FIG. 1 is of the "full panel opening type" intended for a packaging container and comprises an outer configuration 11, in the present case consisting of a mouldable or injection mouldable plastic or corresponding, which forms the mechanically reinforcing and resistant part of the cover. Of course, the element 11 may also comprise further elements or layers.

Along the entire inside of the outer element or layer 11 there is arranged an inner layer 12, which also may comprise several layers, and which is a relatively thin and flexible layer, the main object of which is to give the closure structure specific characteristics, for instance welding characteristics, gas barrier and light barrier.

In the embodiment shown the cover has a generally planar panel 13 and a rim or collar 14 extending around said panel arranged for attachment to the casing of a packaging container (not shown). A short distance inside the rim 14 there is arranged a circumferential weakening or first tearing denotation 15 in the outer layer 11. This tearing denotation is such that flowing out of material, for instance injection moulding may take place from a centrally placed ingot. Of course, the flow of material may be the reverse if necessary.

The inner layer 12, or the so called membrane, which may comprise for instance aluminum foil, metallized plastics film or a gas barrier laminate, is sealed to the outside of the rim 14 in a circumferential region 16. This sealing region 16 merges into a welding region 16', also circumferential, which has a very short radial extension inwards from the weakening 15. The welding regions 16, 16' are located at either sides of the weakening 15 in the outer layer 11, in the present case in the shape of continuously integral welds between the thermoplastic coatings of the layers 12, 11. However, it is obvious that the sealing regions 16, 16' may be arranged in another manner, for instance as discontinuous joints obtained for instance by a two-component glue or similar. However, it is important that the sealing strength of the sealing regions 16, 16' is higher than the strength of the tearing denotation obtained by the weakening 15 and such that it is higher than the tearing strength of the inner layer.

A grip tongue 17 is formed on the outer layer 11 and merges into a reinforcing point 18 adjacent to a pointed region 19 of a second weakening or tearing denotation 20 in the outer layer 11. The tearing denotation 20 is terminated upwards in FIG. 1 by tearing line 20' extending arbitrarily, but not allowed to extend up to the tearing denotation or weakening 15. Towards the other direction in FIG. 1, however, the tearing denotation 20' merges into the first tearing denotation 15 under a tangentially acute angle. By this measure the tearing denotation is defined uniquely and the breaking through operation of the outer and inner layer composite structure is facilitated.

It should be noted that the point 19 is located inside the tearing denotation 15 and in that region of the inner layer 12 which is unsealed or has no adhesive band to the outer layer 11, meaning that when the tongue 17 is gripped and lifted, the outer layer is first broken through at the point 19, and thereafter the tearing follows the tearing denotation 20' by a corresponding manoeuvring of the grip tongue. Finally, the tearing merges into the first tearing denotation, which then is penetrated, without delamination of the inner and outer layers but with penetration of the inner layer.

Within the scope of the accompanying claims there are, of course, other possibilities than the one just identified, for instance an embodiment where a full panel opening is not used but where a smaller opening, for instance for pouring a powder, liquid or other pourable goods is used.

We claim:

1. A closure device for a packaging container, said closure device comprising:

a panel for removably closing said packaging container, said panel having an outer layer and an inner layer, said outer layer and inner layer being separable from one another in a separable region so that a portion of said outer layer can be penetrated and separated from said inner layer without opening the packaging container, and said outer layer and inner layer being connected in an openable region;

a first tearing denotation in the outer layer to facilitate the separation of a portion of said outer layer from said inner layer in said separable region without opening the packaging container;

a tearing element for initiating the tearing of said first tearing denotation in a first tearing direction;

a second tearing denotation in said openable region, said first tearing denotation being connected to said second tearing denotation for initiating the tearing of said second tearing denotation upon the continued tearing of said first tearing denotation in a second tearing direction, said second tearing denotation being constructed and arranged to facilitate the penetration of said outer layer and inner layer at the connection therebetween so that the packaging container can be opened in said openable region upon the tearing of said second tearing denotation, whereby said first tearing direction and said second tearing direction are arranged so that said first tearing denotation must be torn in said second tearing direction to facilitate the penetration of said outer layer and inner layer at the connection therebetween.

2. The closure device in claim 1, wherein the connection between said outer layer and said inner layer in said openable region has a higher resistance to tearing than said secod tearing denotation and than said inner layer.

3. The closure device in claim 2, wherein the connection between said first tearing denotation and said second tearing denotation comprises a merging of said first tearing denotation into said second tearing denotation at an acute angle therebetween.

4. The closure device claimed in claim 1, including an upwardly extending rim about the periphery of said panel, and wherein said second tearing denotation is arranged inwardly adjacent to said rim.

5. The closure device in claim 4, wherein said panel is circular and said second tearing denotation extends circumferentially around said panel.

6. The closure device claimed in claim 5, wherein said tearing element is disposed medially on said panel, and said first tearing denotation includes a first portion on one side of said tearing element and a second portion on the opposite side of said tearing element, said second portion of said first tearing denotation merging with said second tearing denotation at a tangentially acute angle.

7. The closure device claimed in claim 6, wherein the connection between said outer layer and said inner layer includes a sealing member, said sealing member extending circumferentially around said panel and including a first section connected to said rim and a second section connected to said outer layer.

8. The closure devices claimed in claim 1, wherein said tearing element is connected to said first tearing denotation for iniating the tearing thereof, and said tearing element is disposed between the connection of said tearing element and said first tearing denotation and the connection of said first tearing denotation and said second tearing denotation such that said tearing element must be pulled away from the connection of said first tearing denotation and said second tearing denotation to initate the tearing of said first tearing denotation.

9. The closure devices in claim 8, wherein the connection between said outer layer and said inner layer in said openable region has a higher resistance to tearing than said second tearing denotation and than said inner layer.

10. The closure device in claim 9, wherein the connection between said first tearing denotation and said second tearing denotation comprises a merging of said first tearing denotation into said second tearing denotation at an acute angle therebetween.

11. The closure device claimed in claim 8, including an upwardly extending rim about the periphery of said panel, and wherein said second tearing denotation is arranged inwardly adjacent to said rim.

12. The closure device in claim 11, wherein said panel is circular and said second tearing denotation extends circumferentially around said panel.

13. The closure device claimed in claim 12, wherein said tearing element is disposed medially on said panel, and said first tearing denotation includes a first portion on one side of said tearing element and a second portion on the opposite side of said tearing element, said second portion of said first tearing denotation merging with said second tearing denotation at a tangentially acute angle.

14. The closure device claimed in claim 13, wherein the connection between said outer layer and said inner layer includes a sealing member, said sealing member extending circumferentially around said panel and including a first section connected to said rim and a second section connected to said outer layer.

15. The closure device claimed in claim 1, wherein said tearing element is not a part of said outer layer.

16. The closure device in claim 15, wherein the connection between said outer layer and said inner layer in said openable region has a higher resistance to tearing than said second tearing denotation and than said inner layer.

17. The closure device in claim 16, wherein the connection between said first tearing denotation and said second tearing denotation comprises a merging of said first tearing denotation into said second tearing denotation at an acute angle therebetween.

* * * * *